United States Patent [19]

Rhine

[11] Patent Number: 4,910,652

[45] Date of Patent: Mar. 20, 1990

[54] COMBINATION WRIST WATCH AND FLASHLIGHT

[76] Inventor: Gary E. Rhine, 1234 N. Metcalf St., Lima, Ohio 45801

[21] Appl. No.: 380,586

[22] Filed: Jul. 17, 1989

[51] Int. Cl.[4] ..... F21V 33/00

[52] U.S. Cl. ..... 362/234; 362/23; 362/103; 362/191; 362/802; 368/227

[58] Field of Search ..... 362/394, 23, 234, 253, 362/802, 191, 103, 208; 368/227, 10

[56] References Cited

U.S. PATENT DOCUMENTS

| | | | |
|---|---|---|---|
| 2,805,326 | 9/1957 | Schwartz | 362/103 |
| 3,321,617 | 5/1967 | Santana | 362/103 |
| 3,681,587 | 8/1972 | Brien | 362/26 |
| 3,729,923 | 5/1973 | Brigliano et al. | 368/225 |
| 3,783,604 | 1/1974 | Florent et al. | 362/67 |
| 3,855,784 | 12/1974 | Foellner | 362/802 X |
| 4,425,600 | 1/1984 | Barnhart | 362/84 |

FOREIGN PATENT DOCUMENTS

| | | | |
|---|---|---|---|
| 53-3862 | 1/1978 | Japan | 368/227 |

*Primary Examiner*—Stephen F. Husar

*Attorney, Agent, or Firm*—Kenneth R. Bowers, Jr.

[57] ABSTRACT

An analog watch for training children to read the current time having a flashlight installed in the watch case. The flashlight power supply is connected to the light emitting flashlight bulb through an electrical circuit which automatically turns the flashlight off after an adjustable time delay to preserve battery power. The watch time indicating face has numbers and dots to represent hours, and numbers and dots that represent minutes. These may be of different colors and may be adapted to glow in the dark after activation by light from the flashlight or from a face illuminating light source. The watch face has dots at half-hour intervals to indicate that the current time is at the half hour. All hour numbers and time-indicative dots may be embossed on the crystal face of the watch so that the minute hand does not pass over and obscure these symbols.

8 Claims, 1 Drawing Sheet

COMBINATION WRIST WATCH AND FLASHLIGHT

BACKGROUND

This invention relates to wrist watches and to flashlights, especially wrist watches and flashlights which are intended for use by children.

Many wrist watches are available which enable the user to refer to the time of day under conditions of darkness by means of watch dial illumination means. Typically, a small electric light bulb is mounted on the watch face, and is powered by a miniature electric storage cell. Refer to U.S. Pat. No. 3,783,604 to Florent et al., incorporated herein as a first incorporated reference, for an example of a wrist watch.

It is not unknown to mount a search light or flashlight on a user's wrist. Refer to U.S. Pat. No. 4,425,600 to Barnhart, incorporated herein as a second incorporated reference, for a description of a wrist mounted device which provides illumination from an electroluminescent phosphorus lamp for an aircraft cockpit.

Other references of interest are U.S. Pat. Nos. 3,681,587 to Brien, 3,729,923 to Brigliano et al., 3,321,617 to V. G. Santana, and 2,805,326 to S. Schwartz.

No known wrist watch is especially adapted for use by a child in a variety of ways which encourage early and rapid training in the ability to tell time by reading an analog watch.

SUMMARY OF THE INVENTION

A wrist-mountable combined analog watch and flashlight intended for training a child in telling analog time. The flashlight feature includes an automatic time-delayed shutoff of the light used for space illumination to conserve battery power. The face of the watch includes an analog twelve hour dial with numbers representing the twelve hours of a half day spaced around the perimeter of a first circle and dots of a first, color spaced near the first circle midway between each hours' number. The hour hand of the watch points directly at the dot at 30 minutes past the hour. A second circle of diameter greater than the first circle is also present on the face of the watch and has spaced around it numbers from 5 to 60 at intervals of 5, representing the minutes in an hour. There is a dot near the second circle for each minute from one to 60, with a distinguished dot for each minute divisible evenly by 5. The dots around the second circle representing minutes are of a second color not identical to the first color used for the half hours' dots. All symbols indicative of the time may be embossed on the crystal face of the watch so that the movement of the minute hand does not move the minute hand over a symbol to obscure it from the view of the user.

A continuously illuminated button controls the flashlight.

DETAILED DESCRIPTION

In its simplest form, the watch of this invention is intended to be the approximate size and shape of conventional watches which are commonly worn on a human arm using a strap or metal arm band. The watch is fully functional as a timepiece which continuously displays the current time of day or night for reference thereof by the user, and also has a number of features as described below which make the watch of particular use by a child. The internal components which are used by conventional watch timepieces to calculate and display the current time, and perhaps the current date, are well known in the art and form no part of this invention.

Conventional watches can be divided into two general types; analog and digital. An analog watch defines the current time by the positions of mechanical hour and minute hands which rotate about an axis to sweep through a complete circle; passage through 360 degrees requires 12 hours for the hour hand while the same full rotation requires 60 minutes for the minute hand. Generally the user must learn to read the current time by a mental process in which the position of a hand is proportional to the current time, a relationship considered analog in scientific terms. A digital watch, in contrast, displays the current time using a numerical readout of the form HH: MM. SS, where HH refers to the current hour from 01 to 12, MM refers to the current minute from 01 to 59, and SS refers to the current second from 01 to 59. The use of a digital watch has the advantage that the mental process required to read an analog watch is not needed, but nevertheless, analog watches are in wide use and consequently children must learn to read them.

Figure 1:
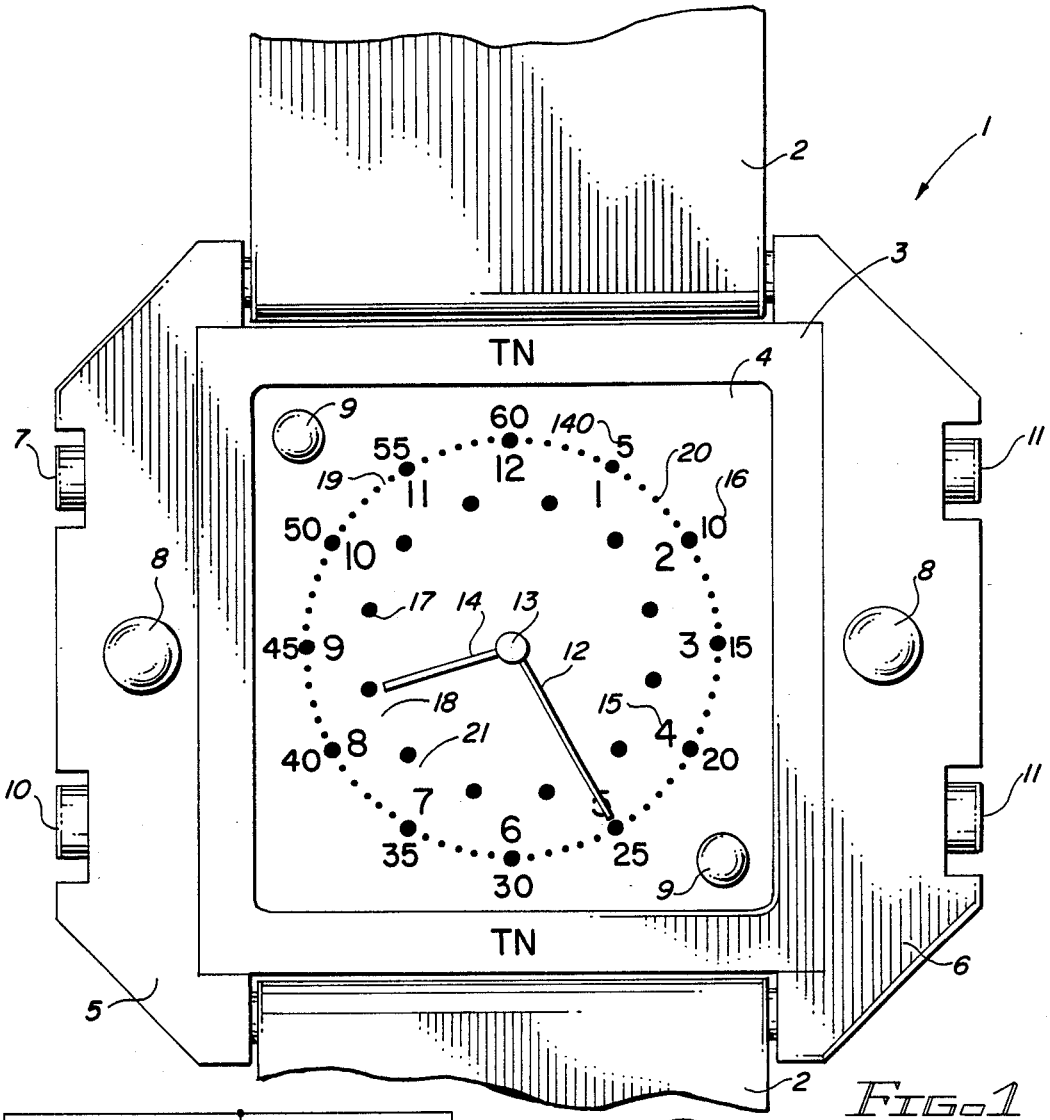
FIG. 1 is a schematic of the face of a wristwatch and flashlight.

Refer to FIG. 1, which generally illustrates the face of an analog watch 1. This drawings shows a cut away arm band 2 which is used to hold watch 1 to the user's arm at the wrist. A watch case 3 comprises a watch timepiece face 4, a flashlight section 5, and a control section 6. Flashlight section 5 has mounted on one surface, a plurality of buttons used to control the flashlight. Button 7 is the on-off button or switch which turns lamp 8 on and off. As shown in FIG. 1, there may be more than one lamp 8, and these may be located at opposite sides of case 3. When turned on, lamp(s) 8 emit a beam(s) of light of sufficient brightness to illuminate a small room or to otherwise serve satisfactorily as a flashlight. Additionally, the brightness of lamps 8 and the disposition of lamps 8 about case 3 should be arranged to illuminate timepiece face 4 so that the watch hands can be seen in the absence of otherwise provided light and so that the time indicative numbers and dots are also then visible. Button 7 may be encased in translucent material which is continuous lit by a light emitting diode (LED) so that button 7 is readily visible in environmental darkness. The LED may also be turned on and off by a position of button 7.

Button 10 is an on-off switch for a plurality of LED's 9 mounted below timepiece face 4 in a position to illuminate face 4 to enable reading the time without turning on lamps 8 if desired.

On a surface of control section 6 are a plurality of recessed buttons 11 as required to set the time and set other features of the watch and flashlight. For example, there may be provided a button 11 which controls the brightness of lamps 8 between a maximum and a minimum as set by the user.

The control circuit for lamps 8 may include a time delay feature which automatically turns off lamps 8 after a set time delay. The length of this time delay can also be adjustable by a control button 11. It is anticipated that a 15 second time delay will best satisfy the desires of a child to briefly illuminate a bedroom at night while minimizing the drain on the power supply required for lamps 8.

Refer to timepiece face 4 in FIG. 1. Along an outer circle 19 defined by the sweep of minute hand 12 about its axis 13, there are numbers 16 from 05 to 60, at intervals of 05. These numbers 16 represent the minutes of an hour. An hour hand 14 is shorter in length than minute hand 12 and rotates about the same axis 13 with the consequence that the end of hour hand 14 sweeps out a circle 21 of smaller radius than the circle 19 defined by the sweep of minute hand 12. About this smaller circle 21, as shown in FIG. 1, there are numbers 15 from 1 to 12, representing the hours of a half day.

Figure 3:
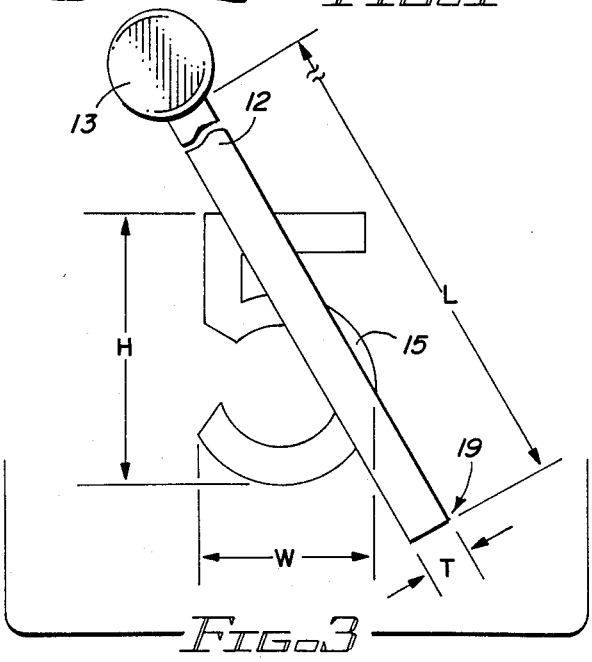
FIG. 3 is a schematic of a detail from FIG. 1.

Each hand 12 and 14 can be considered to be approximately a rectangle, having a very small thickness T and a large length L (see FIG. 3). The width of minute hand 12 must be smaller, or approximately one-third, of the height and width of the hour numbers 15 because this minute hand 12 obscures an hour number when positioned over it. By using a relatively thin minute hand, as compared to the height of an hour number, even a covered hour number is readable. Refer to FIG. 3 which shows a minute hand 12 of thickness T passings over an exaggerated hour number 15, in this case a "5", of height H and width W. Because thickness T of minute hand 12 is much less than height H and Width W of hour number 15, passage over hour number 5, intended to be typical of all hour numbers in size, by minute hand 12, does not obscure hour number 15 to an extent which would render it hard to read.

Refer again to FIG. 1. A series of circular dots 17 (one labeled) are disposed around the perimeter of a circle 18 centered at axis 13. Circle 18 is smaller in diameter than the circle defined by the sweep of the end of minute hand 12 but is slightly greater in diameter than the circle defined by the sweep of the end of hour hand 14 with the consequence that dots 17 are never obscured by hour hand 14 but can be obscured when minute hand 12 passes thereover a particular dot 17. Dots 17 are located around circle 18 in positions which correspond to the half-hour positions of hour hand 14 and therefore identify to the user that the time of day is at a half-hour by the fact that hour hand 14 points directly at a dot 17.

Along circle 19, the circle circumscribed by the end of minute hand 12, there is a plurality of small dots 20 which represent the positions of minute hand 12 at intervals of one minute. Minute dots 20 and minute numbers 16 should be a different color than the half-hour dots 17 and hour numbers 15 to make reading the time easier for children.

Minute dots 20, half-hour dots 17, hour numbers 15, and minute numbers 16 may all be painted on timepiece face 4 using a paint containing a material which is photo-activated upon absorption of light photons, or in simpler terms, a material which glows in the dark. This allows even a small amount of light from lamps 8 to light up the symbols needed to make the time readable in darkness.

In FIG. 1, the letters "TN" are shown on timepiece face 4. This represents the tradename of the watch and is also to be transposed on the watch face or crystal using a photo-activated material.

Figure 2:
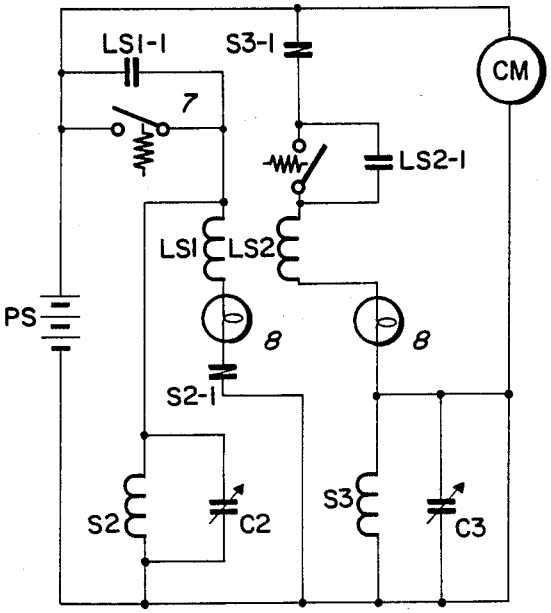
FIG. 2 is an electrical diagram of the flashlight circuit.

Refer to FIG. 2. This electrical diagram is illustrative of the general components which can be used in this watch and is illustrative rather than limiting. PS is the battery power supply which can be any one of many batteries commercially available which are small enough to fit inside a watch case. Switch 7 is the switch 7 of FIG. 1 and is spring loaded open. When manually closed, switch 7 energizes lock-in solenoid LS1 and lamp(s) 8 through deenergized-closed solenoid contacts S2-1. C2 is a variable capacitor which may be adjusted to require 15 seconds to become charged. When so charged, C2 energizes solenoid coil S2, thereby opening solenoid contacts S2-1, deenergizing lamp(s) 8. LS1 is a lock-in solenoid which closes deenergized-open solenoid relay contacts LS1-1 to keep lamp(s) 8 energized even after switch 7 is manually released.

Switch 10 is the same component as switch 10 of FIG. 1 and is spring loaded open. When switch 10 is manually closed, Lamp(s) 9 are energized. A lock-in solenoid LS2 closes contacts LS2-1 to keep lamp(s) 9 energized when switch 10 is released. C3 is a variable capacitor which may be adjusted to require 15 seconds to become fully charged and to energize solenoid coil S3. When solenoid coil S3 is energized, deenergized-closed solenoid contacts S3-1 are opened, deenergizing lamp(s) 9.

The clock motor CM is always energized.

Refer again to FIG. 1. Timepiece face 4 is composed of a translucent material such as glass or plastic and is designated a "crystal" in this specification and in the claims. In a preferred embodiment of the invention, the hour numbers 15 are located on the crystal with the advantage that the numbers cannot be obscured by passage of minute hand 12. Half hour dots 17 may also be located on the crystal. Embossment of items 15 and 17 (15 and 17 only are symbols indicative of the time of day), on the crystal prevents visual obscuring by minute hand 12 because minute hand 12 passes below the crystal. The crystal is between the observer and minute hand 12. This arrangement helps to direct light from lamps 8 and LEDs 9 onto numbers 15, and dots 17, making them easily visible in darkness.

It is believed that the watch as described by this specification will be of especial use in training small children in reading time from an analog watch because of the combination together of the flashlight feature with the above-described timepiece face having colors and dots which make reading time easy. The child is expected to wear the watch when sleeping in a darkened room because the watch serves as a flashlight which can be used to light up the child's bedroom on occasions when desired. The flashlight turns itself off 15 seconds after being turned on to preserve the battery life, it being assumed that the child, in a sleepy state, might not do so.

While in the specification, the claims, and in the drawings, a general device has been described, it should be understood that modifications can be made without departure from the spirit and scope of the invention. For example, the flashlight could have a battery power supply which is separate from the time keeping clock, or the flashlight feature could be combined with a digital timepiece.

In this entire specification, in the claims, and in the drawings, similar numerals denote similar features.

I claim:

1. A time keeping and displaying wrist mountable watch having a flashlight mounted in the case thereof, said flashlight comprising a power supply for supplying electrical power to said flashlight, said power supply electrically connected to at least one light source, and time delay means for automatically extinguishing said light source after a time delay following the energization of said light source by the electrical deenergization of said light source.

2. The watch of claim 1 having an electrical switch which controls the flashlight, serving as an on-off switch, wherein said on-off switch is itself continuously lit.

3. The watch of claim 1 having an electrical switch which controls the flashlight, serving as an on-off switch, wherein said on-off switch is itself continuously lit by a light emitting diode.

4. The watch of claim 1 having symbols indicative of the time of day embossed on the crystal face of the watch.

5. A time keeping and displaying wrist mountable analog watch having a flashlight mounted in the case thereof, said flashlight comprising a power supply for supplying electrical power to said flashlight, said power supply electrically connected to at least one light source, and time delay means for automatically extinguishing said light source after a time delay following the energization of said light source by the electrical deenergization of said light source, and said analog watch having minute numbers and minutes dots positioned to represent minutes on the face of said watch which minute numbers and minute dots are of a first color, and having thereon said watch face hour numbers and hour dots positioned to represent hours of time wherein said hour numbers and hour dots are of a second color not identical to said first color.

6. The watch of claim 5 wherein said analog watch has a minute hand 12 the position of which is proportional to the present minute of the current time of day, said minute hand 12 being dimensionally approximately a rectangle having a thin thickness T which is substantially smaller than the width W of the hour numbers 15 such that minute hand 12 cannot obscure numbers 15 by passage over said hour numbers 15.

7. The watch of claim 5 wherein said watch further comprises a plurality of half-hour dots, being small circular dots positioned along the perimeter of a circle at positions proportional to the intervals of half-hours of current time.

8. The watch of claim 5 having symbols indicative of the time of day embossed on the crystal face of the watch.

* * * * *

US004910652C1

(12) EX PARTE REEXAMINATION CERTIFICATE (8159th)

United States Patent

Rhine

(10) Number: US 4,910,652 C1

(45) Certificate Issued: Apr. 19, 2011

(54) COMBINATION WRIST WATCH AND FLASHLIGHT

(76) Inventor: Gary E. Rhine, Lima, OH (US)

Reexamination Request:
No. 90/005,694, Apr. 3, 2000

Reexamination Certificate for:

| | |
|---|---|
| Patent No.: | **4,910,652** |
| Issued: | **Mar. 20, 1990** |
| Appl. No.: | **07/380,586** |
| Filed: | **Jul. 17, 1989** |

(51) Int. Cl.
*F21V 33/00* (2006.01)

(52) U.S. Cl. ..... 362/234; 362/23; 362/103; 362/191; 362/802; 368/227; 968/895; 968/939

(58) Field of Classification Search ..... 362/23, 362/103, 191, 208, 234, 253, 394, 802; 368/10, 368/227

See application file for complete search history.

(56) References Cited

U.S. PATENT DOCUMENTS

| | | | | | |
|---|---|---|---|---|---|
| 2,805,326 | A | * | 9/1957 | Schwartz | 362/103 |
| 2,916,871 | A | | 12/1959 | Wegner | 58/50 |
| 3,321,617 | A | * | 5/1967 | Santana | 362/103 |
| 3,514,939 | A | | 6/1970 | Cattin | 58/50 |
| 3,535,282 | A | * | 10/1970 | Mallory | 200/60 |
| 3,633,355 | A | * | 1/1972 | Sakata | 368/296 |
| 3,681,587 | A | * | 8/1972 | Brien | 362/26 |
| 3,729,923 | A | * | 5/1973 | Brigliano et al. | 368/225 |
| 3,783,604 | A | * | 1/1974 | Florent et al. | 368/67 |
| 3,855,784 | A | * | 12/1974 | Foellner | 368/67 |
| 3,943,694 | A | | 3/1976 | Hofer | 58/19 C |
| 4,417,819 | A | | 11/1983 | Migeon | 368/67 |
| 4,425,600 | A | * | 1/1984 | Barnhart | 362/84 |
| 4,527,096 | A | | 7/1985 | Kindlmann | 315/169.3 |
| 4,705,407 | A | | 11/1987 | Brien | 368/227 |
| 4,875,147 | A | | 10/1989 | Auer | 362/205 |
| 4,972,394 | A | | 11/1990 | DiMarco | 368/227 |

FOREIGN PATENT DOCUMENTS

| | | |
|---|---|---|
| JP | 52-151060 | 12/1977 |
| JP | 53-3862 | 1/1978 |
| JP | 53-25467 | 3/1978 |
| JP | 53-86258 | 7/1978 |
| JP | 53-115271 | 10/1978 |
| JP | 55-121185 | 9/1980 |
| JP | 57-96478 | 6/1982 |
| JP | 63-70601 | 5/1985 |

OTHER PUBLICATIONS

Hattori Seiko News, "A Digital Watch with 100 Channel Memory—A New Sports Watch for Runners", Sep. 7, 1988, pp. 1–3 (with translation).

Hasbro, Inc, Playskool 1986 Catalog, p. 109 (1986).

* cited by examiner

*Primary Examiner*—Margaret Rubin

(57) ABSTRACT

An analog watch for training children to read the current time having a flashlight installed in the watch case. The flashlight power supply is connected to the light emitting flashlight bulb through an electrical circuit which automatically turns the flashlight off after an adjustable time delay to preserve battery power. The watch time indicating face has numbers and dots to represent hours, and numbers and dots that represent minutes. These may be of different colors and may be adapted to glow in the dark after activation by light from the flashlight or from a face illuminating light source. The watch face has dots at half-hour intervals to indicate that the current time is at the half hour. All hour numbers and time-indicative dots may be embossed on the crystal face of the watch so that the minute hand does not pass over and obscure these symbols.

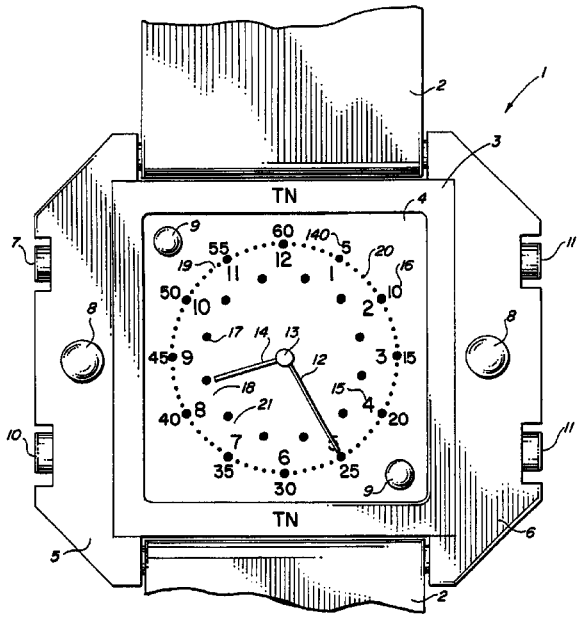

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 3 and 5-8 is confirmed. Claims 1 and 4 are cancelled.

* * * * *